US008201287B2

(12) United States Patent
Oetting

(10) Patent No.: US 8,201,287 B2
(45) Date of Patent: Jun. 19, 2012

(54) MOISTURE BARRIER

(76) Inventor: Bill Oetting, Tucson, AZ (US)

( * ) Notice: Subject to any disclaimer, the term of this patent is extended or adjusted under 35 U.S.C. 154(b) by 137 days.

(21) Appl. No.: 12/799,377

(22) Filed: Apr. 23, 2010

(65) Prior Publication Data

US 2011/0258954 A1 Oct. 27, 2011

(51) Int. Cl.
*A47K 3/00* (2006.01)
*A47K 3/16* (2006.01)
*E04B 5/00* (2006.01)

(52) U.S. Cl. ..... 4/613; 4/614; 52/35; 52/408

(58) Field of Classification Search ..... 52/35, 302.1, 52/302.3, 302.6, 408; 4/496, 612–614
See application file for complete search history.

(56) References Cited

U.S. PATENT DOCUMENTS 1,017,167 A * 2/1912 Pleins ..... 4/613
1,633,685 A * 6/1927 Stark ..... 52/35
2,757,385 A * 8/1956 Whittick ..... 4/613
3,182,767 A * 5/1965 Kuehl ..... 52/272
3,281,172 A * 10/1966 Kuehl ..... 52/592.1
3,462,771 A * 8/1969 Moretti ..... 4/613
3,800,335 A * 4/1974 Buonaura ..... 4/613
4,899,402 A * 2/1990 Maynard et al. ..... 4/663
5,299,330 A * 4/1994 Moore et al. ..... 4/604
5,371,980 A * 12/1994 Dix ..... 52/34
5,845,347 A * 12/1998 Young ..... 4/613
2010/0064430 A1 * 3/2010 Goodson ..... 4/613

* cited by examiner

*Primary Examiner* — Joshua J Michener
*Assistant Examiner* — Keith Minter
(74) *Attorney, Agent, or Firm* — A. Boegemann Law Firm; Les A. Boegemann

(57) ABSTRACT

A moisture barrier is formed between a water bearing floor surface and external material, such as flooring or water bearing wall surfaces, wherein the water bearing floor surface includes an embedded water barrier membrane incorporated into one or more of the edges of the water bearing floor surface. The water bearing floor surface may include a shower floor pan, sink, or similar water collecting surface. The external material may include water bearing wall surfaces, such as FRP, or flooring material, such as ceramic tile or epoxy flooring materials. The combination of the water barrier membrane and external materials creates a water proof seal without caulk or other sealant which does not deteriorate with time and usage. Also, the invention may include a non-porous adjacent material including a notch for accepting the water barrier membrane and wherein the water barrier membrane is glued or otherwise affixed to the water bearing floor surface.

12 Claims, 2 Drawing Sheets

MOISTURE BARRIER

BACKGROUND OF THE INVENTION

1. Field of the Invention

The present invention relates to a vapor/moisture/water barrier for use in residential and commercial applications of any wall and bathroom fixtures such as shower pans, counter tops, and the like. More specifically, the invention relates to a marriage of two membranes to form a seal that prevents moisture from permeating under external flooring materials or impregnating wall materials.

2. Description of the Prior Art

The use of shower pans, counter tops, and the like is well known in the industry. In a residential or light use environment, moderate means of retaining moisture are generally sufficient as there are generally lengthy periods of time wherein any errant water or moisture may wick from any adjacent flooring or wall material or evaporate. However, in more industrial settings, such as college dorm rooms, and the like, the usage of the facility is generally so pervasive that high humidity and constant presence of moisture prevents the wicking and/or evaporation of any errant water. Accordingly, a means of preventing moisture from permeating adjacent surfacing materials is necessary. In commercial and residential uses this is used as a water barrier to stop water damage and subsequent mold issue from water wicking into the walls. This is done by using a non-porous horizontal material coupled with a water membrane that is attached to a solid floor application.

One means for attempting to remedy this situation is to caulk or use other sealants to form a moisture barrier and joints and seams. However, improper application or subsequent shrinkage or damage may cause the indicated joints and seams to be less than effective. Another means may be to extend the surface of the moisture producing facility (shower, bathtub, sink, etc.) onto the adjacent surfacing material. However, this may result in a very expensive flooring or wall surfacing material being applied to the moisture producing facility or result in the moisture bearing surface being expanded beyond an anesthetically pleasing point. Accordingly, a means of preventing the permeation of moisture into or below adjacent surfacing materials is necessary that does not rely solely on caulks and sealants.

SUMMARY OF THE INVENTION

The present invention overcomes the disadvantages and limitations of the prior arts by providing a means of preventing the permeation of adjacent materials with moisture utilizing a double membrane junction in horizontal applications and a unitary membrane placed behind a moisture bearing surface in a vertical application. Alternatively, a membrane may be attached to a non-porous surface, such as a baseboard, and the membrane then glued to the water bearing surface, such as a floor. The novel application of joining two dissimilar materials that creates a water proof seal may be applied to the flooring and walls in any room along with walls of showers, dry off areas, counter tops, or any wet area including surgical suites and laboratories. Additionally, the application of a baseboard or similar device to a floor or similar surface with a membrane may be useful for preventing damage to a non-moisture bearing surface such as a wall of a home or similar.

Various other purposes and advantages of the invention will become clear from its description in the specification that follows and from the novel features particularly pointed out in the appended claims. Therefore, this invention comprises the features hereinafter illustrated in the drawings, fully described in the detailed description of the preferred embodiments, and particularly pointed out in the claims. However, such drawings and description, as well as this Summary of the Invention, disclose just a few of the various ways in which the invention may be practiced and are not limiting on the invention.

DESCRIPTION OF THE INVENTION

The present invention overcomes the disadvantages and limitations of the prior arts by providing a means preventing the permeation of adjacent materials with moisture utilizing a double membrane junction in horizontal applications and a unitary membrane placed behind a moisture bearing surface in a vertical application. The novel application of joining two dissimilar materials that creates a water proof seal may be applied to the flooring and walls of showers, dry off areas, counter tops, or any wet area including surgical suites and laboratories.

A water proof membrane is attached directly to a shower pan, wall, or counter top either glued or embedded directly in the pan or threshold. The membrane extends in front of the pan with ample material for the flooring installer to adhere the flooring membrane to this pane membrane extension. No seam is left requiring sealant or caulking. Alternatively, a membrane may be attached to a non-porous surface, such as a baseboard, and the membrane then glued to the water bearing surface, such as a floor.

In a tile application, the water proof membrane is attached appropriately under the thin-set and above the dry pack so the flooring installer can tie into the waterproof membrane that is covering the dry area floor. For wall extension applications, the water proof membrane is embedded into the pan or adhered directly to the pan extending up around the pan protecting the wall and stopping the moisture from escaping the shower area. The membrane can be attached to the full circumference of the side walls and back or only on the corners providing protection at the seams of the shower wall in the corners. Counter tops are attached to the back with the membrane extending upwards which can be covered by the back splash material. The proprietary process is the joining of the two dissimilar materials enabling a water proof seal to be obtained for the flooring and walls of showers, dry off area, counter tops, or any wet areas including surgical suites and laboratories. The benefit of this new application is that caulk or sealant is not relied on to maintain a water proof seal. The membrane does not deteriorate or seams delaminate with time and usage, making a long term water proof connection for all applications.

Figure 1:
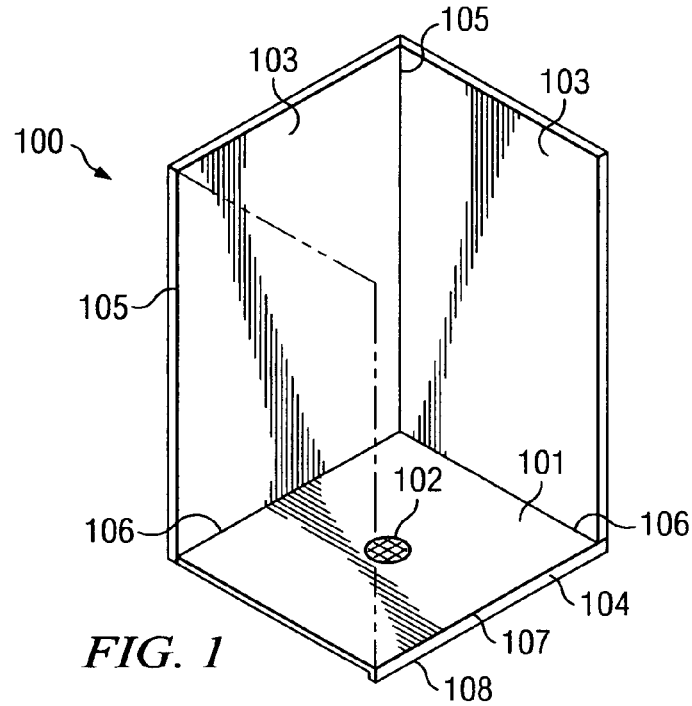
FIG. 1 is an illustration of a moisture producing facility such as a shower or similar environment.

Referring to the figures, wherein like parts are designated with like reference numerals and symbols, FIG. 1 is an illustration of a moisture producing facility such as a shower 100 having a water bearing floor surface 101, a drain 102, walls 103, a threshold 104, wall-to-wall seams 105, wall-to-floor pan seams 106, floor pan-to-threshold seam 107, and threshold-to-floor seam 108. Potential undesirable escape paths for moisture include the wall-to-wall seams 105 where the walls meet each other, the wall-to-floor pan seams 106, floor pan-to-threshold seam 107, and threshold-to-floor seam 108.

Figure 2:
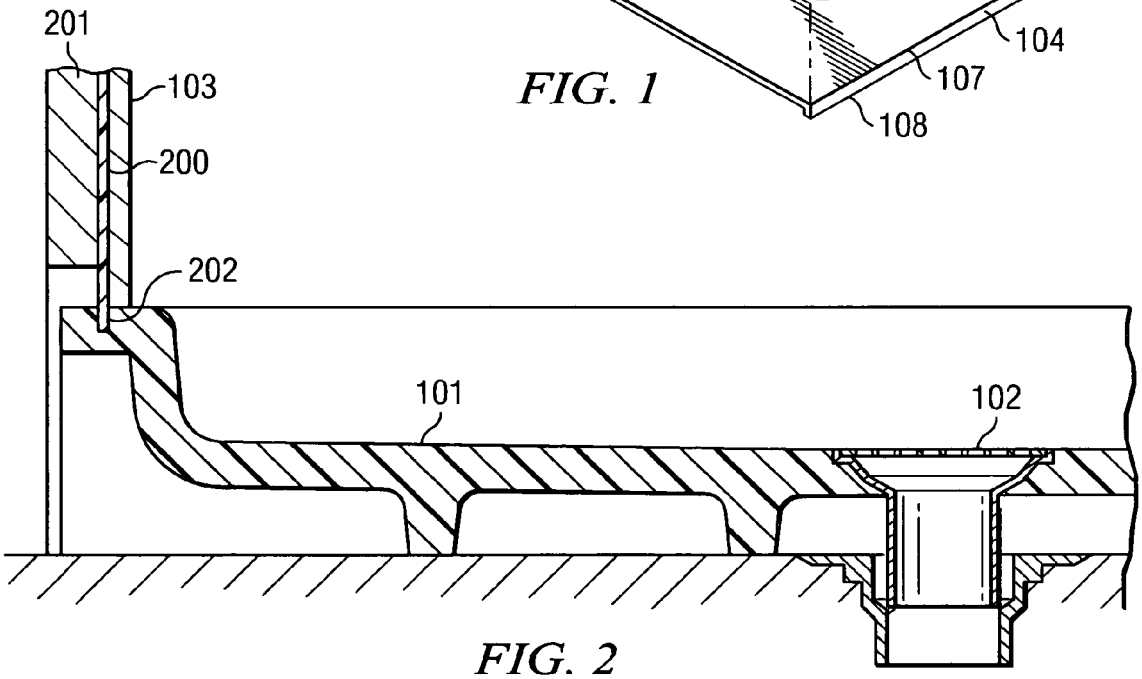
FIG. 2 is illustration of the wall-to-floor seam of the shower of FIG. 1 illustrating the novel invention including an embedded water barrier membrane.
Figure 3:
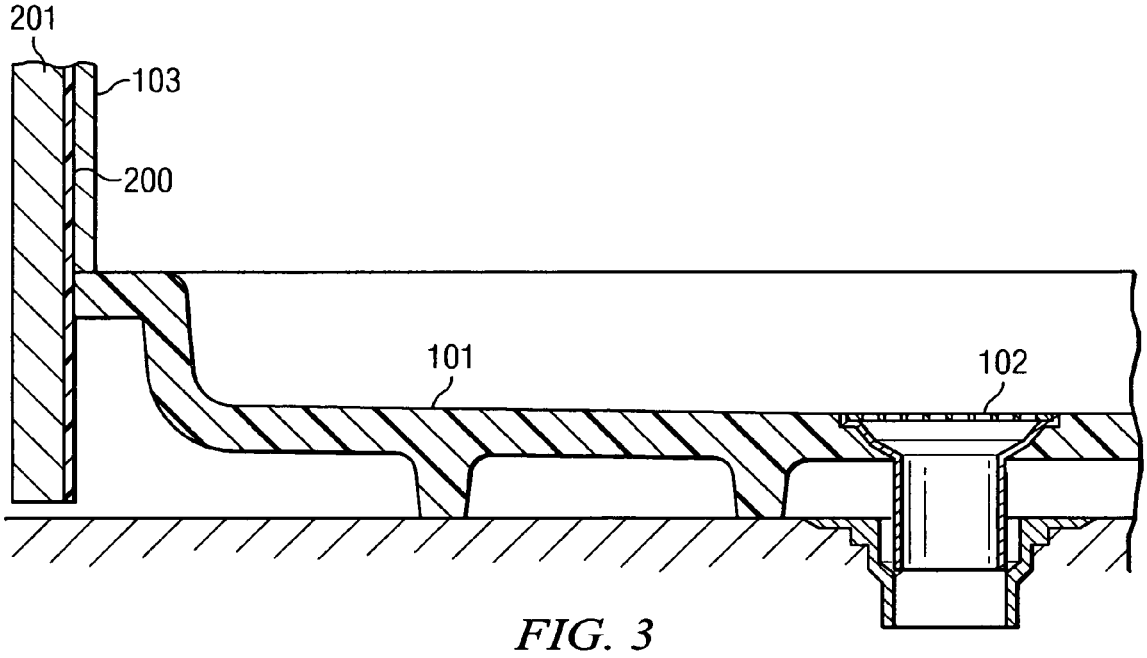
FIG. 3 is an illustration of an alternate embodiment of the wall-to-floor seam of the shower of FIG. 1 illustrating an alternate placement of the water barrier membrane.

FIG. 2 illustrates a wall-to-floor pan seam 106 utilizing the instant invention. Here, a water barrier membrane 200 is inserted into a notch 202 placed in the water bearing floor surface 101. The water barrier membrane 200 extends vertically and is placed behind a water bearing wall surface of the wall 103, such as FRP or the like. Optionally, a backer 201 may be placed behind the water barrier membrane 200. Also, optionally, the water barrier membrane 200 may be glued into the notch 202 of the water bearing floor surface 101. An alternate embodiment of this application of the invention is illustrated in FIG. 3, wherein the water barrier membrane 200 is placed between the water bearing surface 101 and a backer 201. In such an application, the water barrier membrane 200 may be either glued to the water bearing floor surface 101, glued to the backer 201 or held in place by the pressure of the wall 103 applied to the backer 201 through the water barrier membrane 200. As previously indicated, the water barrier membrane may be applied to the entire wall-to-floor pan seam 106 and may be utilized in the corners, thereby protecting the wall-to-wall seams 105.

Figure 4:
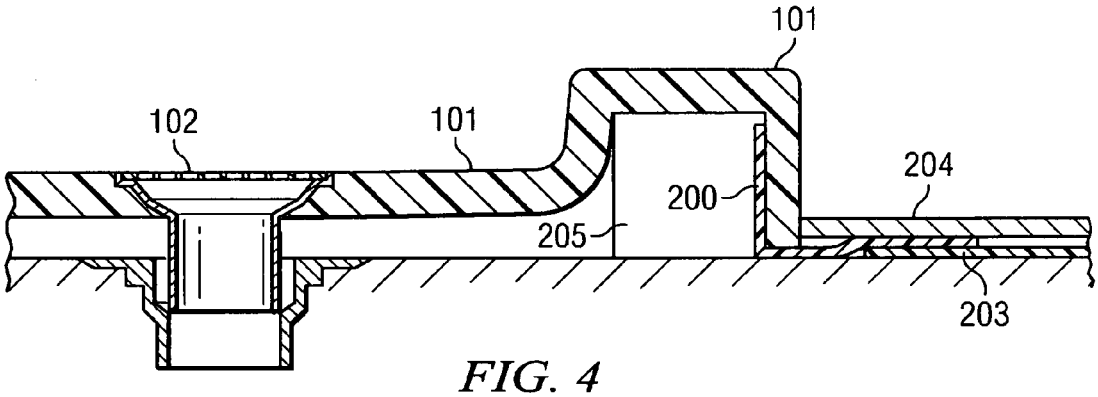
FIG. 4 is an illustration of a horizontal application of the invention.
Figure 5:
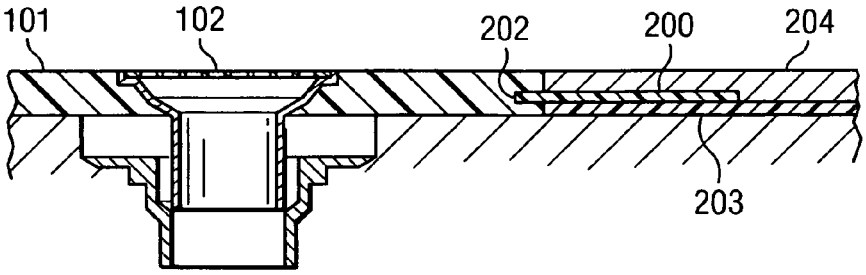
FIG. 5 is an illustration of an alternate embodiment of the invention illustrated in FIG. 4, but without the application of a physical threshold.

FIG. 4 illustrates a horizontal application of the invention. In this embodiment of the invention, a water bearing surface 101 is married to flooring material 204 at a threshold 205. The water barrier membrane 200 is adhered into or embedded to the water bearing floor surface 101 and is allowed to extend to the point that it overlaps an exterior membrane 203 and is sandwiched by the flooring material 204. The exterior membrane 203 is optional and installed at the discretion of the flooring installer. In one embodiment of the invention, the water barrier membrane 200 may be glued or melted into the notch 202. FIG. 5 illustrates a similar horizontal application, but without the threshold 205. Here, the water bearing floor surface 101 includes a notch 202 into which the water barrier membrane 200 is inserted. As before, the water barrier membrane 200 may be optionally glued into the notch 202. The water barrier membrane 200 sits on top of an optional external membrane 203 such as thin set in tile applications. The flooring material 204 is placed over the water barrier membrane, thus creating a seal.

Figure 6:
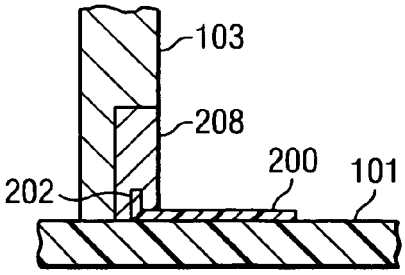
FIG. 6 is an illustration of yet another embodiment of the invention wherein the water barrier membrane is affixed to a non-porous adjacent material.
Figure 7:
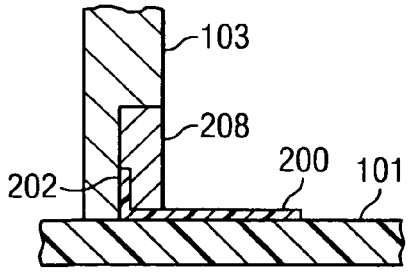
FIG. 7 is an illustration of an embodiment of the invention similar to that of FIG. 6, having a notch disposed along a major surface of the non-porous material rather than along its edge.

FIG. 6 illustrates a water barrier system similar to that of FIG. 2. However, in this embodiment of the invention, the water barrier membrane 200 is inserted into a notch 202 placed in a non-porous adjacent material 208, such as a ceramic baseboard and then is glued to the water bearing floor surface 101. In this case, the water bearing floor surface 101 is truly the floor and the intent is to prevent wicking of moisture up the wall 103. Such as application is useful anywhere it is desirable to wash down a floor or there is the potential of flooding caused by, for example, a ruptured plumbing pipe or a storm related watershed event. As in the other embodiments, the water barrier membrane 200 may be glued, melted, or otherwise affixed within the notch 202. An alternate embodiment of this application of the invention is illustrated in FIG. 7, wherein the notch is located along a surface of the non-porous adjacent material 208 rather than along an edge.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

I claim:

1. A water barrier comprising, a water bearing floor including an upper surface forming a water receiving cavity and a first notch disposed on the upper surface along a first edge of the upper surface of the water hearing floor;

a vertical water bearing material resting on the first edge of the upper surface of the water bearing floor including a first surface including a non-porous material facing the water receiving cavity and a second surface facing away from the water receiving cavity;

a vertical water barrier membrane inserted into the first notch and adjacent to the second surface of the vertical water bearing material whereby the combination of the first notch in the upper surface, the vertical water barrier membrane inserted into the first notch and the vertical water bearing material form a wall-to-floor seam;

a threshold having a top edge, an interior edge facing the cavity, and an exterior edge;

a second edge of the upper surface of the water bearing floor adapted to conform to the top edge and the exterior edge of the threshold;

an external water barrier membrane disposed on a floor next to and in close proximity to the exterior edge of the threshold;

a third water barrier membrane forming a substantially, ninety degree angle with a horizontal surface resting on top of the external water barrier membrane and a vertical surface placed adjacent to the exterior edge of the threshold; and a flooring material resting on top of the horizontal surface of the third water barrier membrane and the external water barrier membrane;

wherein the second edge of the upper surface of the water hearing floor is placed adjacent to the vertical surface of the third water harrier and on top of the horizontal surface of the third water barrier membrane and adjacent to the flooring material so as to form a floor-to-floor seam.

2. The water barrier of claim 1, wherein the vertical water barrier membrane is affixed to the water bearing floor with glue.

3. The water barrier of claim 1, wherein the vertical water barrier membrane is glued within the first notch.

4. The water barrier of claim 1, wherein the vertical water barrier membrane is melted into the first notch.

5. The water barrier of claim 1, wherein the water barrier is adapted to be utilized in a wet area.

6. The water barrier of claim 5, wherein the wet area comprises a shower.

7. A water barrier comprising, a water bearing floor including an upper surface forming a water receiving cavity and a first notch disposed on the upper surface along a first edge of the upper surface of the water bearing floor;

a vertical water bearing resting on the first edge of the upper surface of the water bearing floor including a first surface including a non-porous material facing the water receiving cavity and a second surface facing away from the water receiving cavity;

a vertical water barrier membrane inserted into the first notch and adjacent to the second surface of the vertical water bearing material whereby the combination of the first notch in the upper surface, the vertical water barrier membrane inserted into the first notch and the vertical water bearing material form a wall-to-floor seam;

a substantially flat and horizontal second edge of the upper surface of the water bearing floor having a second notch disposed along a vertical edge of the second edge of the upper surface of the water hearing floor;

an external water barrier membrane disposed on a floor adjacent to the vertical edge of the second edge of the upper surface of the water bearing floor;

a third water barrier membrane inserted into the second notch of the vertical edge of the second edge of the upper surface of the water bearing floor and placed on top of the external water barrier membrane; and a non-porous flooring material placed adjacent to the vertical edge of the second edge of the upper surface of the water bearing floor and on top of the third water barrier membrane and on top of the external water barrier membrane so as to form a floor-to-floor seam.

8. The water barrier of claim 7, wherein the vertical water barrier membrane is affixed to the water bearing floor with glue.

9. The water barrier of claim 7, wherein the vertical water barrier membrane is glued within the first notch.

10. The water barrier of claim 7, wherein the vertical water barrier membrane is melted into the first notch.

11. The water barrier of claim 7, wherein the water barrier is adapted to be utilized in a wet area.

12. The water barrier of claim 11, wherein the wet area comprises a shower.

* * * * *